US005384922A

United States Patent [19]

Jobe

[11] Patent Number: 5,384,922

[45] Date of Patent: Jan. 31, 1995

[54] FOOT TURN TABLE FOR WHEEL CHAIR PATIENTS

[76] Inventor: Timothy L. Jobe, 9322 S. Carey Rd., Lithia, Fla. 32547

[21] Appl. No.: 149,277

[22] Filed: Nov. 9, 1993

[51] Int. Cl.[6] ..... A61G 12/00

[52] U.S. Cl. ..... 5/81.1; 5/507.1

[58] Field of Search ..... 5/81.1, 507.1, 662

[56] References Cited

U.S. PATENT DOCUMENTS

| | | | |
|---|---|---|---|
| 2,757,388 | 8/1956 | Chisholm | 5/507.1 |
| 2,963,713 | 12/1960 | Forrest | 5/507.1 |
| 3,911,509 | 10/1975 | Fleckenstein | 5/507.1 |
| 4,829,612 | 5/1989 | Adams | 5/81.1 |
| 5,054,137 | 10/1991 | Christensen | 5/81.1 |
| 5,079,789 | 1/1992 | Jandrakovic | 5/81.1 |

*Primary Examiner*—Michael F. Trettel

[57] ABSTRACT

Disclosed is a turntable, to be placed at the front of a wheel chair, either portable, or, being a part of the wheel chair itself, and having a feet restraint system on the upper surface of the turntable, to restrain the patients feet in a desired position, during the transfer of the patient to a bed, or reverse transfer.

2 Claims, 3 Drawing Sheets

FOOT TURN TABLE FOR WHEEL CHAIR PATIENTS

BACKGROUND OF INVENTION

This invention relates to an apparatus and method of aiding a wheel chair patient to be extracted from a wheel chair to a bed, and to aid the attendant in removing the patient from the wheel chair, and transferring them to a bed. This transfer usually involves lifting the patient from the chair to a standing position, then having to turn, or, orient, or turn them, while in the stationary standing position, and aiding them in setting down on a bed, or other convenience. It has been customary to maneuver the patient in the wheel chair to a position approaching the bed, lock the wheels of the wheel chair in this stationary location, and then, using a lifting device, usually a strap around the patients body, lift the patient to a standing position, turn them 180 degrees, and maneuver them to a sitting position on the edge of the bed, and then aid them in laying down, and maneuvering them to a prone position. The reverse action is required in order to transfer the patient from the bed to the wheel chair.

During this maneuver, especially in the act of turning the patient 180 degrees, while in the erect position, with the patients weight on the floor, the patients feet can easily become tangled, causing a problem in re-orienting the feet to conform to the turning motion of the body. In many cases, this is a very painful experience to the patient, and, in the case of a hip, or leg injury, serious damage to the injury can occur. In the case of patients with alzheimer's disease, the patient becomes dis-oriented, and is unable to cooperate with the attendant, and a lengthy process ensues, with the attendant having the problem of holding the patients weight during the turning of the feet. It is customary to have an additional attendant to accomplish this task.

Nothing was discovered in the prior arts, which focused on this particular problem. However, the art of providing an apparatus to turn an object 180 degrees, and even 360 degrees, is well known in the prior arts, however, none of the prior arts address the problem of transferring a patient from a wheel chair to a bed, and addressing the problems encountered in this maneuver. This act requires locating a wheel chair in the required position, placing the patients feet at the required transfer location, restraining the patients feet at that location, lifting the patient to a standing position, rotating the patient 180 degrees, and especially including the patients feet, and allowing the patient to be easily seated on the edge of the bed, without entangling their feet, and then aiding the patient in assuming the prone position on the bed.

In U.S. Pat. No. 4,354,654, Werner teaches a Swivel Mounting Unit which enables the user to turn an object 360 degrees. This art has too many restrictions on the type of device to be rotated, and would not be conducive to a patient in a wheel chair, and, also has no provision for placing the wheel chair in the correct position and location, and keeping it in that location. Also, no method is taught for restraining the patients feet during the maneuver Kawai, in U.S. Pat. No. 5,209,446, teaches a similar Swivel, or, Rotary stand, having a slideable, or, adjustable circle, for the top of the device to turn in a predetermined area, on the base of the device. Here again, this device is not adaptable to a patient in a wheel chair, where stability of the patient is the main concern, and stability of the wheel chair during the transfer process is of the utmost concern. Also, no provision is anticipated for the restraint of the patients feet during the transfer process.

In U.S. Pat. No. 4,566,664, Donald demonstrates the prior art usage of these turntable type units, wherein he teaches a counter mounted rotary device, for mounting an appliance. Here again, no consideration is anticipated for a transfer of a patient from a wheel chair to a bed, and the weight of the patient, and the restraint of the patients feet, and the wheel chair, during the transfer process.

SUMMARY OF THE INVENTION

Accordingly, it is an object of this invention to provide a method and apparatus to aid in the transfer of a wheel chair patient from the wheel chair to the bed, and from the bed to the wheel chair.

Another object of this invention is to provide an apparatus which will enable the operator of the wheel chair to lock the apparatus in place in relation to the wheel chair, in the proper position, when performing the transfer to the bed, or from the bed.

Another object of this invention is to provide feet restraints for the patient, when making the transfer from, or to, the bed.

Another object of this invention is to provide this apparatus as a portable piece of equipment, to be easily stored until needed.

Still another object of this invention is to provide this apparatus as an attachable, and foldable piece of equipment, which can be a part of the wheel chair, available to the patient, or the operator, at any time, and can be retracted under the wheel chair, or extended for use, when not needed.

In carrying out this invention in the illustrative embodiment thereof, a rotary turntable, capable of supporting the weight of the patient, is placed on the floor at a location conducive to transferring a patient from a wheel chair to a bed. The turntable has a base plate, with four indentations, one indentation at each of the corners, for purposes of parking the wheel chair, and holding the wheel chair in place, firmly against the base plate. Now, the base plate has a set of bearing type supports attached into its upper central surface, and, a rotator plate is attached onto the base plate, by a shouldered bolt through its center peripheral, in a manner to allow the rotator plate to contact the bearing supports on its underside, and, as the bearings are attached onto the upper surface, the rotator plate is allowed to rotate 360 degrees on top of the base plate.

Also, the rotator plate has a restraint system for the patients feet.

In operation, the portable turntable is placed in a strategic location beside the bed, the patient is wheeled to the turntable, and the wheels are fitted into two of the indentations of the base plate, and the wheel chair is locked into that position. Now, the patients feet are fitted into the restraints, the patient is lifted to an erect position, and then the patient is rotated to a position which will allow them to be easily set on the bed, and helped to a prone position.

In the case where the turntable is retractably attached to the bottom of the wheel chair, the patient is wheeled to the position beside the bed, the turntable is extended from under the wheel chair, using the rotatable, leverage bar system, and the turntable is set firmly on the floor. The patients feet are then placed in the foot restraints, then lifted to a prone position, and rotated correctly, and set on the bed. The turntable apparatus is then retracted under the wheel chair to an out of the way position. All of this accomplished without worry about the orientation of the patients feet.

Conveniently, the operator may wheel the patient to the bed, either use the portable turntable, or, extend the wheel chair attached turntable, place the patients feet in the restraints, lift the patient to a prone position, rotate the patient as required, and set them on the bed, and the patients feet never become a problem.

BRIEF DESCRIPTION OF THE DRAWINGS

This invention, together with other objects, features, aspects and advantages thereof, will be more clearly understood from the following description, considered in conjunction with the accompanying drawings.

Three sheets of drawings are furnished, sheet one contains FIG. 1, and FIG. 2, sheet 2 contains FIG. 3, and FIG. 4, and sheet 3 contains FIG. 5, and FIG. 6.

DESCRIPTION OF THE PREFERRED EMBODIMENTS

Figure 1:
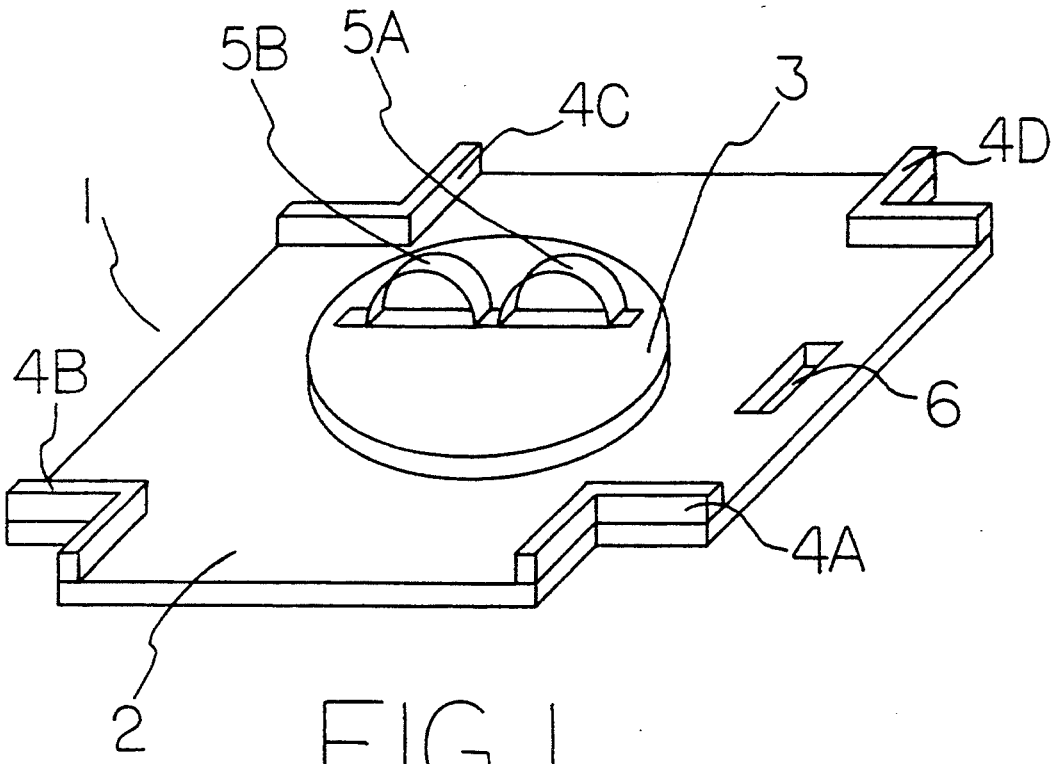
FIG. 1 is an isometric view of the invention, showing the four indented corners, and the rotary top, with the foot restraints.

Referring now to FIG. 1, a portable, and storeable foot turn table for wheel chair patients, referred to generally by the reference numeral 1 is made of suitable material, and has a bottom base plate 2, which is positioned flat on the floor. Base plate 2 has four indented, and raised corners, 4*a*, 4*b*, 4*c*, and 4*d*, for purposes of parking the wheels of a wheel chair in a stationary position. Base plate 2 also has a cut out 6, which provides for carrying the base plate 2. A top rotary plate 3 is rotatably attached onto the top of base plate 2 by means of mounting hardware, which firmly attaches top rotary plate 3 onto base plate 2, and allows top rotary plate 3 to rotate in a 360 degree circle. Top rotary plate 3 has foot restraints 5*a*, and 5*b* attached onto its upper surface, for placing the patients feet into position for turning, and holding them in this position.

Figure 2:
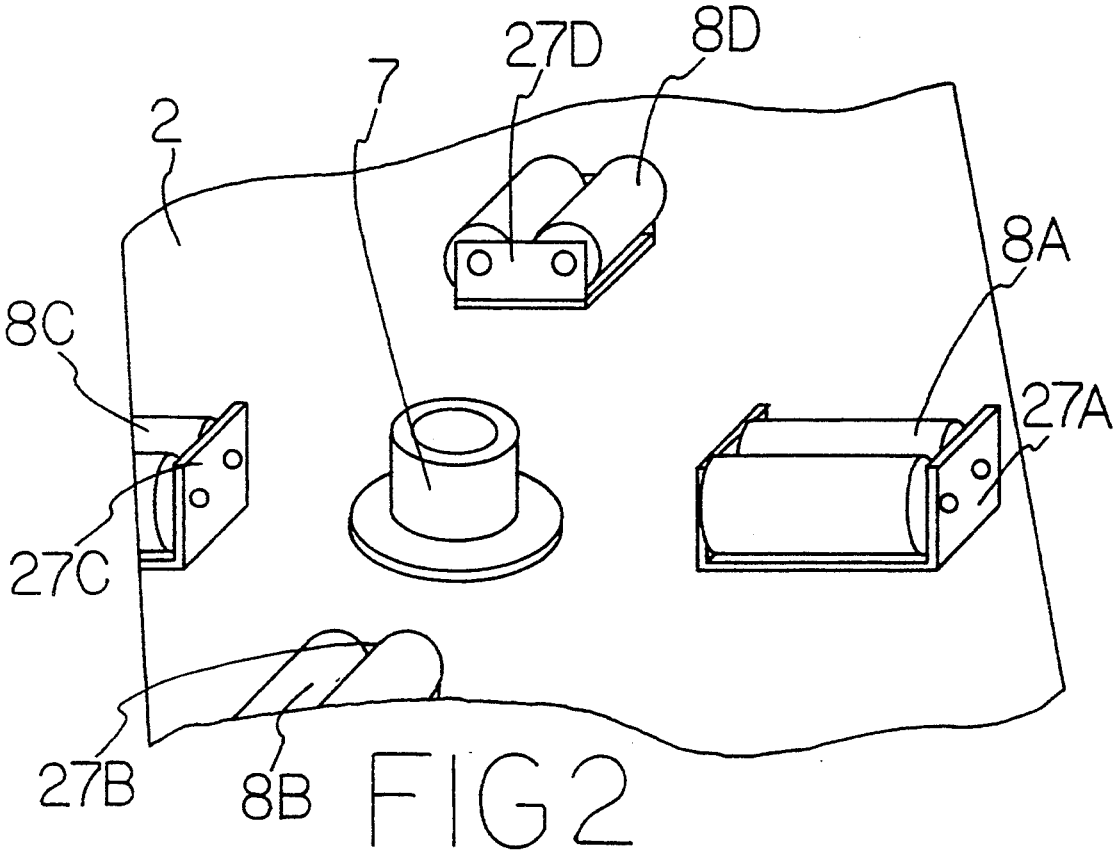
FIG. 2 is an isometric view of the base plate, with the center rotatable mounting opening, and the bearing support system.

Progressing to FIG. 2 we see a top cutaway view of the base plate, showing four bearings, 8*a*, 8*b*, 8*c*, and 8*d*, attached onto the top surface of base plate 2 by mounting flanges 27*a*, 27*b*, 27*c*, and 27*d*. Also seen in FIG. 2 is the center mounting flange 7, providing rotating mounting for the top rotary plate 3.

Figure 3:
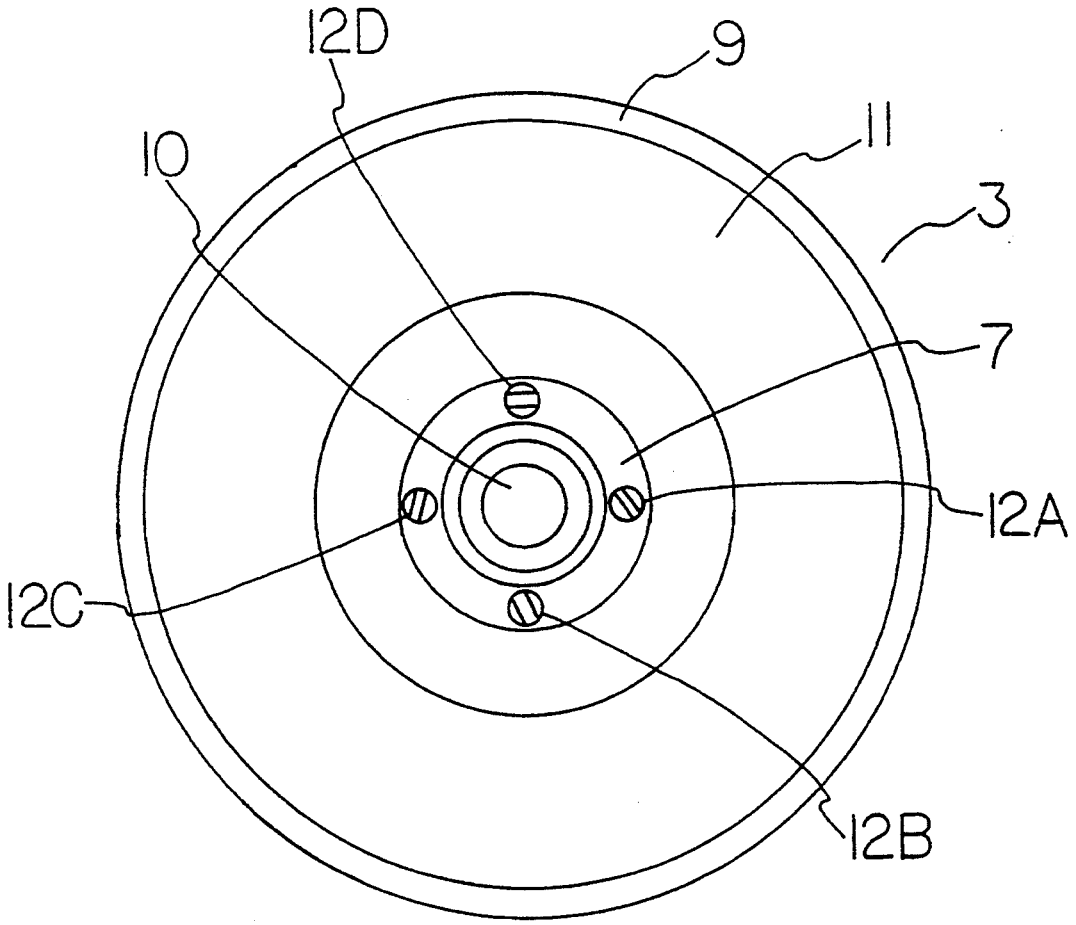
FIG. 3 is a bottom view of the rotary top piece, showing the center opening for the mounting screw, and the bearing race surface for the bearing system.
Figure 4:
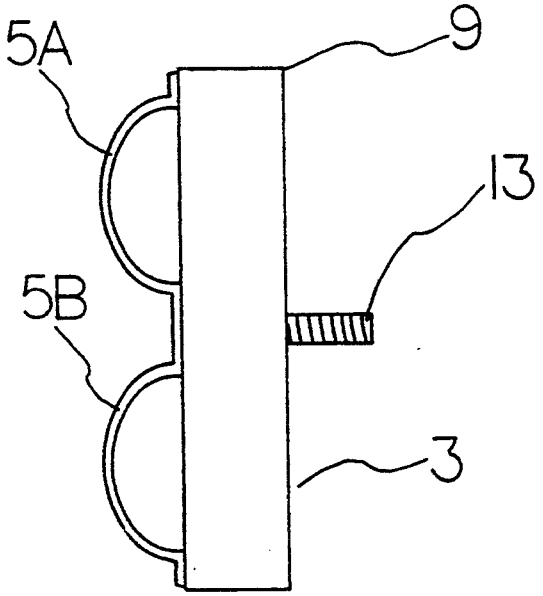
FIG. 4 is an end view of the rotary top piece, showing the mounting bolt in place, and the foot restraints.
Figure 5:
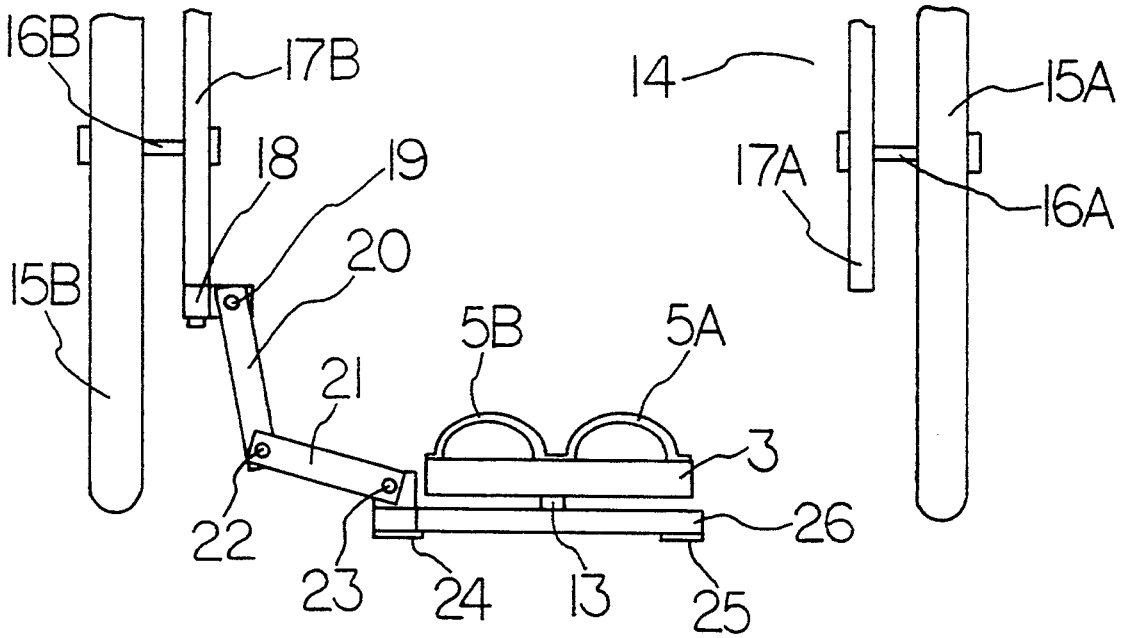
FIG. 5 is a front view of the turntable, retractably attached onto the main support tube of the wheel chair, showing the rotary, and swivel joints, used to retract, and to extend the turntable, and place it firmly on the floor, in the desired position.

Progressing on to FIG. 3 we see a bottom view of rotary plate 3 having an outer peripheral edge 9 of a height to cover most of the distance produced between base plate 2, and top rotary plate 3, and to protect bearings 8*a*–8*d* from the elements. Top rotary plate 3 having bearing race surface 11, and center mounting flange 7, secured by flange mounting screws 12*a*, 12*b*, 12*c*, and 12*d*. Flange 7 has opening 10 in its center, to accommodate mounting bolt 13, more easily seen in FIG. 4, which attaches top rotor plate 3 onto base plate 2, top rotary plate 3 resting on bearings 8*a*–8*d*, thereby allowing top rotary plate 3 to rotate freely on base plate 2. Progressing now to FIG. 5, we see another embodiment of the foot turntable for wheel chair patients, which is retractably attached onto the wheel chair 14, and is not portable. Still referring to FIG. 5 we see wheels 15*a*, and 15*b* of wheel chair 14 attached to tubes 17*a*, and 17*b* by mounting hardware 16*a*, and 16*b*. Now, top rotary attachment 18 is attached onto tube 17*b*, and also serves as mounting for top swivel joint 19, which allows first support piece 20 to swivel. First support piece 20 is attached to second support piece 21, and it is allowed to swivel also, by center swivel joint 22. Now, second support piece 21 is attached to a retractable bottom base plate 26 by bottom swivel joint 23, and bottom rotary attachment 24. This swiveling, and rotating hardware allows retractable bottom base plate 26 to be extended from the underside of wheel chair 14, extended outward, and placed flat on the floor, for purposes of transferring the patient from the wheel chair 14 to a bed, not shown. Levelling pad 25 keeps base plate 26 level.

Figure 6:
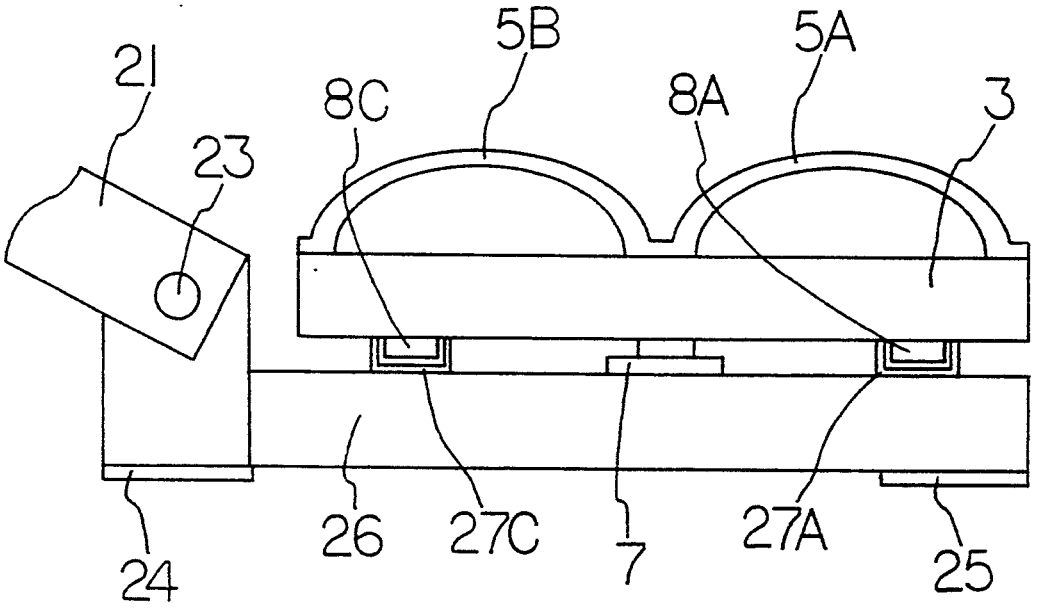
FIG. 6 is an elevation view of the turntable system, showing the attachment to the retracting hardware.

In FIG. 6 we see a front cutaway view of the retractable base plate 26, showing the 2nd support piece connected to bottom rotary attachment 24, and bottom rotary attachment 24 inserted into retractable base plate 26, top rotary plate 3 being the same rotary plate as seen in FIG. 1.

Accordingly, a very unique, attractive, convenient method and apparatus are provided for aiding in the transfer of a patient from a wheel chair to a bed, without having to contend with the position of the patients feet during the transfer. This invention also keeps the patients feet in a restrained, rotatable position, allowing for a more easy transfer of the patient to a bed.

Since minor changes and modifications varied to fit particular operating requirements and environments will be understood by those skilled in the art, the invention is not considered limited to the specific examples chosen for purposes of illustration, and includes all changes and modifications which do not constitute a departure from the true spirit and scope of this invention as claimed in the following claims and reasonable equivalents to the claimed elements.

What is claimed is:

1. A foot turn table for wheel chair patients, comprising:

a base plate, a rotary top plate, a set of bearings, and a set of mounting hardware;

said base plate made of a substantially square piece of flat material, said base plate having a thickness to provide suitable stability, said base plate having an upper surface, a lower surface, four indented corners, said corners being thicker than the remainder of said base plate, said thicker corners and said indentations providing safe, positioned, parking means for a wheel chair, while transferring a patient to a bed, said base plate attaching a circular pattern of said bearings on said upper surface, said base plate also having handle means for carrying purposes, said rotary top plate being a substantially rounded piece of material, having a top surface, a bottom surface, an outer peripheral edge of an overhanging design, said outer peripheral edge providing covering means for said bearings, and said bottom surface of said rotary top plate providing bearing race means for said bearings, said top rotary plate having rotatable attaching means for attaching said top rotary plate onto said top surface of said base plate, said bearings engaged said top surface of said base plate, and said bottom surface of said top rotary plate, thereby providing easy rotating means to said top rotary plate, said top rotary plate having foot restraining means for a patient, said foot restraining means, and said rotary top plate thereby rotatably restraining said feet of said patient during a transfer of said patient from said wheel chair.

2. A foot turntable for wheel chair patients as stated in claim 1, wherein said base plate is of a substantially circular design, and said circular base plate has mounting means for a rotatable attachment to a retracting system, and said retracting system having rotatable attaching means to the framework of a wheel chair, said retracting system being a plurality of swiveling supports for said base plate, thereby allowing said base plate to be retracted under said wheel chair, or, extended to a position in front of said wheel chair, and said base plate thereby having means for being firmly placed on the floor in front of said wheel chair, thereby providing rotary means for the said feet of said patient during said transfer of said patient from said wheel chair to a bed.

* * * * *